United States Patent [19]

Paine et al.

[11] 4,335,485

[45] Jun. 22, 1982

[54] VARIABLE PITCH TROWELS

[76] Inventors: John N. Paine, 1 Douglas Dr., Newport News, Va. 23601; Kim A. Lopdrup, 1101 Roseneath Rd., Florence, S.C. 29501

[21] Appl. No.: 111,342

[22] Filed: Jan. 11, 1980

[51] Int. Cl.[3] ..... E01C 19/44

[52] U.S. Cl. ..... 15/235.8

[58] Field of Search ..... 15/235.8, 244 A, 144 R, 15/144 A

[56] References Cited

U.S. PATENT DOCUMENTS

| | | | |
|---|---|---|---|
| 988,457 | 4/1911 | Glasscock | 15/235.8 |
| 1,021,557 | 3/1912 | Runner | 15/235.8 |
| 1,713,513 | 4/1927 | Abram | 15/235.8 |
| 2,278,283 | 3/1942 | Raptis | 15/144 A |
| 2,613,384 | 10/1952 | Collins | 15/244 A |
| 2,834,199 | 5/1958 | Freeman | 15/235.8 |
| 2,999,261 | 9/1961 | Lapham | 15/235.8 |
| 3,090,066 | 5/1963 | Ferrell et al. | 15/235.8 |
| 3,146,481 | 9/1964 | Chiuchiarelli | 15/235.8 |
| 3,729,765 | 5/1973 | Peterson | 15/235.8 |
| 3,798,701 | 3/1974 | Irwin et al. | 15/235.8 |

*Primary Examiner*—Edward L. Roberts

[57] ABSTRACT

This troweling device for finishing wet concrete consists of a long, detachable handle assembly which is attached to a trowel or bull float blade by means of a pitch adjusting mechanism. This pitch adjusting mechanism allows the user to alter the angle of the blade in relation to the handle assembly while the trowel is in use by axially rotating the handle assembly. The pitch adjusting mechanism consists of a worm thread cylinder which is held in engagement to the geared portion of a geared support structure by a pivoting outer housing. This outer housing encloses the worm thread cylinder and pivots upon the geared support structure. The handle assembly is attached to the worm thread cylinder and the blade is attached to the geared support structure. Axial rotation of the handle assembly, therefore, causes the worm thread cylinder to be axially rotated and thereby advance and retreat along the geared support structure, thus changing the angle of the handle assembly in relation to the blade. All parts of the device are easily disassembled to enable the user to administer proper maintainance.

6 Claims, 3 Drawing Figures

VARIABLE PITCH TROWELS

BACKGROUND OF THE INVENTION

The invention is in the field of concrete finishing devices, generally referred to as bull floats and speed trowels. In concrete work, the finisher must often use these long-handled trowels and floats to finish large pours of concrete. In such work it is of paramount importance to tilt the blade of the tool to keep it on its back edge with respect to the direction of the push or pull. Often the finisher may not be able to raise the handle of a conventional tool high enough to achieve the pitch necessary to pull the tool back from a long distance. It is known that devices have been patented teaching various means by which the pitch of the trowel or float can be adjusted. None of these devices has been commercially accepted due to problems such as susceptability to wear, difficulty of maintainance, overly-complicated design, the awkwardness of having to use two hands to operate some of these devices, a torque problem in some one-handed devices, and the limited number of blade positions in some devices.

SUMMARY OF THE INVENTION

This variable pitch trowel enables the angle of the smoothing blade relative to the handle to be altered by axial rotation of the handle. Unlike previous inventions using the principle of handle rotation to alter blade pitch as the trowel is in motion, this device uses a geared support structure and threaded worm cylinder which significantly reduces the torque on the handle and thereby facilitates greater ease of use. Other features include an enclosed housing which reduces the device's succeptability to wear, adaptability to the natural axial arm motion of either left or right handed users, suitability for use with extension handles and an unlimited number of blade angles.

The geared support structure consists of a troughed gear with angled teeth and a base through which bolts are used to fasten the device to a trowel blade or bull float blade. The threaded worm cylinder consists of a partially threaded cylinder which, when rotated, advances and retreats along the geared support structure. The threaded worm cylinder is secured to the geared support structure by a housing which pivots on a retaining pin inserted laterally through the geared support structure. In addition to the external threading of the worm cylinder, the cylinder is internally threaded to facilitate insertion of a threaded rod which is thereby secured by a collar and a retaining pin inserted laterally through the collar, the worm cylinder, and the handle simultaneously. The described rod may include a similar fastening device on the end away from the blade to facilitate the use of extension handles.

BRIEF DESCRIPTION OF THE DRAWINGS

FIG. 3 is a fragmentary top plan view of the device as shown in FIG. 1.

DESCRIPTION OF THE PREFERRED EMBODIMENT

Figure 2:
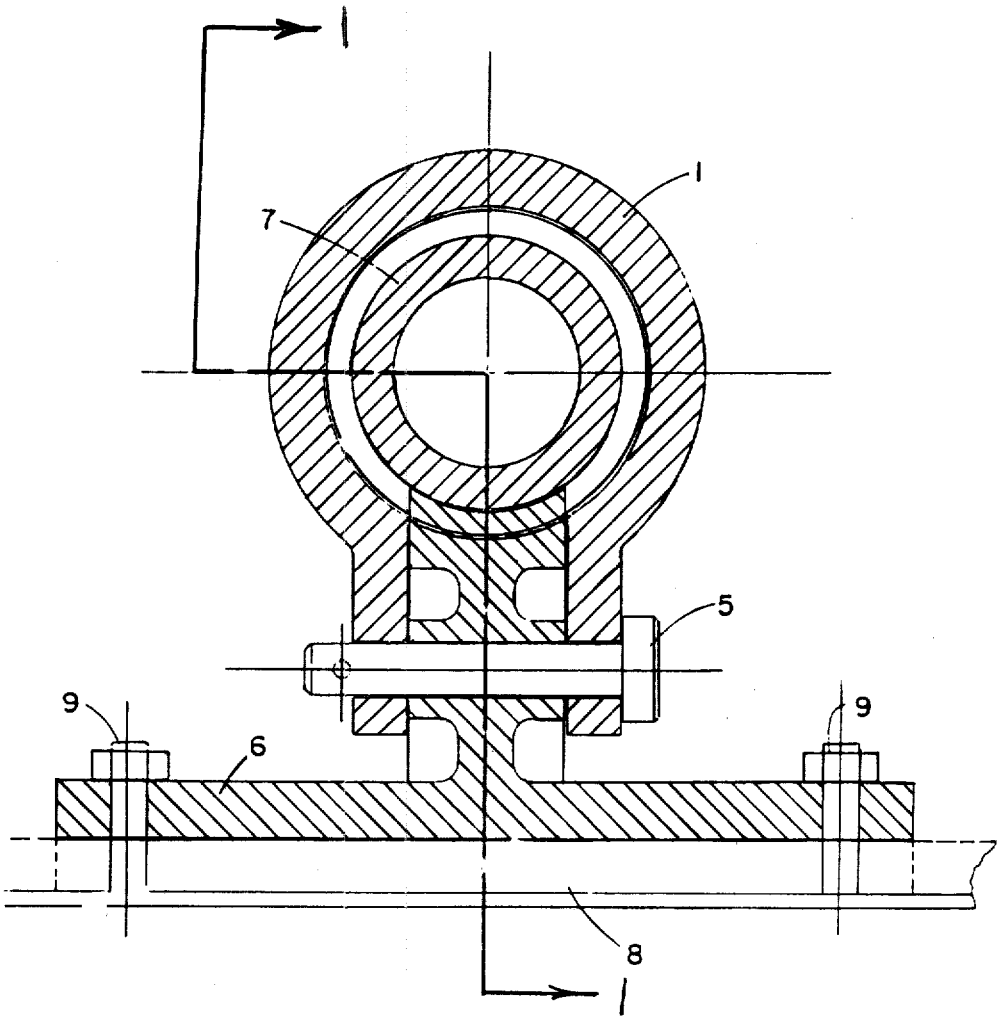
FIG. 2 is a sectional view of the gearing mechanism shown with the front of the tool cut away along the line labeled 2—2 in FIG. 1.

Referring now to the drawings, the invention comprises a concrete finishing trowel or float means 8 onto which a geared support structure is secured by bolt means 9, which is inserted through two holes in the plate of said geared support structure 6 as shown in FIG. 2. The geared support structure 6 has a bore completely through its side, allowing the pivoting pin means 5 to be inserted through two triangular ears extending vertically downward from an open-ended housing means 1 to both sides of the geared support structure 6, thus securing the outer housing 1 to the geared support structure 6 in FIG. 2.

A worm thread cylinder means 7 fits into the top geared trough of the geared support structure 6 and is held in place by the outer housing 1, which is secured to the geared support structure 6 by pivoting pin means 5 through the side of the geared support structure 6 as described above and shown in FIG. 2. The rotation of worm thread cylinder 7 by the rod 4 (as described later) causes the threads to advance and retreat along the geared support structure 6, causing a change in the angle of the trowel or float blade 8 in relation to the rod 4 as shown in FIG. 1.

Figure 1:
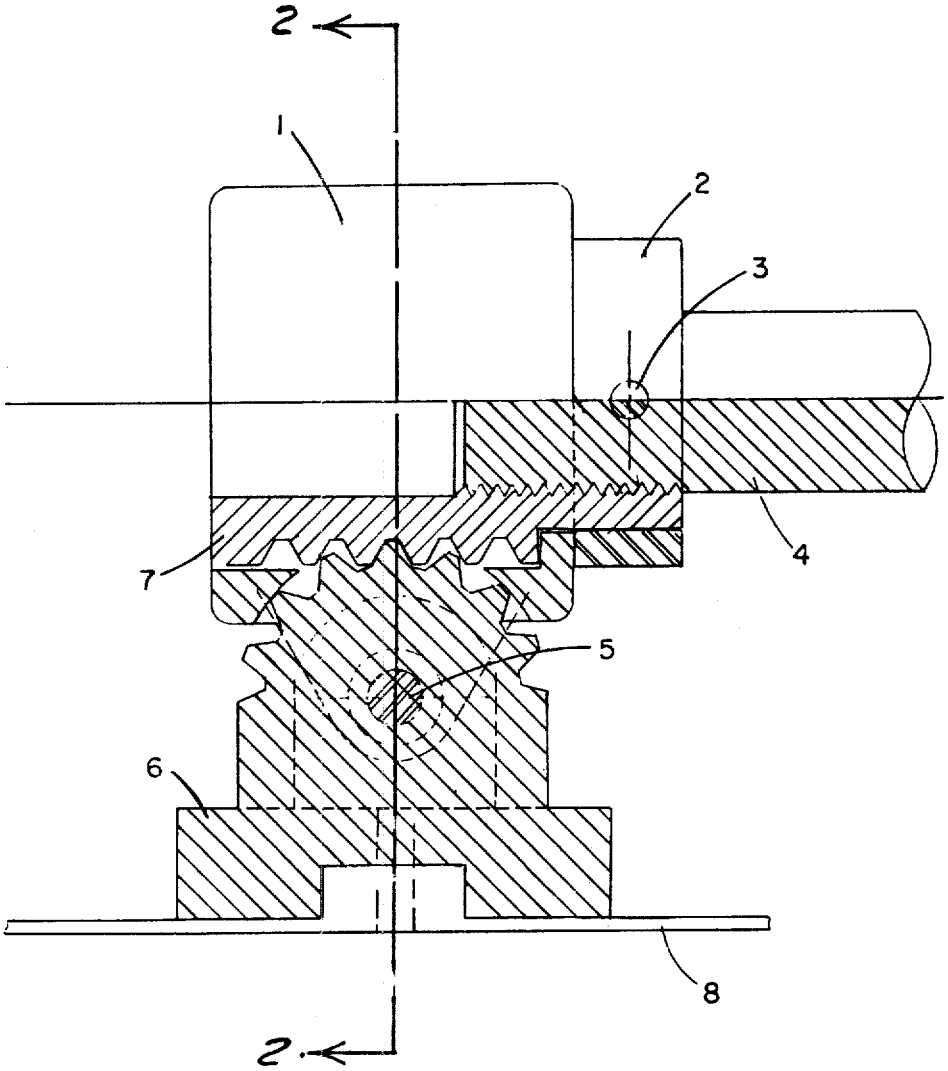
FIG. 1 is a longitudinal sectional view taken along line 1—1 of FIG. 2 of the gearing mechanism shown with the handle inserted, and depicting the top half as it appears from the outside.

The worm thread cylinder 7 is hollowed in the center to allow for internal female threading as shown in FIG. 1. The threaded rod 4 is thus screwed into the inner diameter of the worm thread cylinder 7. To further secure the rod 4 in such a manner to eliminate the unscrewing of the threaded rod 4 with respect to the worm thread cylinder 7 as the rod is axially rotated, a securing pin means 3 as shown in FIG. 1 and FIG. 3 is inserted simultaneously through a collar means 2 (to be described below), the worm thread cylinder means 7, and the threaded rod 4. With the tool assembled as shown in FIG. 3, axially rotating the rod 4 causes the worm thread cylinder 7 shown in FIG. 1 to advance and retreat along the geared support structure 6. The structure comprising rod 4, collar means 2 and securing pin means 3 as assembled in FIG. 1 shall be referred to as the handle assembly. The structure comprising the handle assembly and worm thread cylinder 7 as assembled in FIG. 1 shall be referred to as the control assembly.

As shown in FIG. 1, a restrictive collar means 2 is secured by the securing pin means 3 to prevent said handle assembly from advancing into the pivoting outer housing 1. The collar 2 has a larger diameter than the diameter of the hole in the rear of housing 1 as shown in FIG. 1, thus restricting inward advancement of the control assembly. The worm thread cylinder cannot retreat out of the housing 1 because the threads of worm thread cylinder 7 are larger in diameter than the diameter of the hole in the rear of housing 1 as shown in FIG. 1.

Both the pivoting pin means 5 shown in FIG. 2 and the securing pin means 3 as shown in FIG. 3 are secured by cotter pins to prevent pin displacement during use. Although construction as described is feasible, practical, economical, and durable, it should be recognized that other constructions are possible within the generic preview of the following claims.

We claim as our invention:

1. A variable pitch trowel comprising a trowel face adapted to smooth concrete mix and the like, a handle assembly for said trowel face, and a pitch adjusting assembly attaching said handle assembly to said trowel face; said pitch adjusting assembly comprising a geared support structure which is secured to said trowel face, a worm thread cylinder which is secured to said handle assembly and engaged with said geared support structure and which is adapted to cause said worm thread cylinder, when axially rotated, to advance and retreat along said geared support structure, a pivoting outer housing which is secured to said geared support structure but free to pivot thereon and which is adapted to hold said worm thread cylinder in engagement with said geared support structure, and a pivoting means connecting said geared support structure to said pivoting outer housing.

2. A variable pitch trowel of claim 1, wherein said worm thread cylinder has at least one spiral groove on the outer cylindrical surface thereof.

3. A variable pitch trowel of claim 2, wherein said geared support structure comprises a base with a semi-circular gear extending vertically from said base.

4. A variable pitch trowel of claim 3, wherein said semi-circular gear is adapted to allow said worm thread cylinder to mesh with and, when rotated, to advance and retreat along said gear in such a manner that the angle of said worm thread cylinder with respect to said base increases or decreases.

5. A variable pitch trowel of claim 4, wherein said handle assembly and said worm thread cylinder are connected in such a manner that axial rotation of said handle assembly causes similar axial rotation of said worm thread cylinder.

6. A variable pitch trowel of claim 5, wherein said pivoting outer housing is a harness adapted to hold said worm thread cylinder in engagement with said geared support structure in such a manner that said worm thread cylinder is free to advance and retreat along said semi-circular gear by means of axial rotation.

* * * * *